US009394148B2

(12) United States Patent
Biondich et al.

(10) Patent No.: US 9,394,148 B2
(45) Date of Patent: Jul. 19, 2016

(54) LIFTING APPARATUS AND METHOD OF LIFTING

(71) Applicant: The Boeing Company, Chicago, IL (US)

(72) Inventors: Kyle Steven Biondich, Bothell, WA (US); Kyle L. Oberst, Everett, WA (US); Zachary D. Talus, Seattle, WA (US); Brian M. Hansen, Lynnwood, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/525,972

(22) Filed: Oct. 28, 2014

(65) Prior Publication Data

US 2016/0115003 A1 Apr. 28, 2016

(51) Int. Cl.

| | |
|---|---|
| ***B66F 19/00*** | (2006.01) |
| ***B66F 9/06*** | (2006.01) |
| ***B66F 9/075*** | (2006.01) |

(52) U.S. Cl.

CPC ..... *B66F 9/06* (2013.01); *B66F 9/07554* (2013.01)

(58) Field of Classification Search

CPC ..... B66F 3/22; B66F 7/065; B66F 7/085; B66F 9/0655; B66F 9/07554; B66F 9/22

See application file for complete search history.

(56) References Cited

U.S. PATENT DOCUMENTS 3,825,132 A * 7/1974 Colangelo ..... B66C 23/48 254/326
3,901,478 A * 8/1975 Peterson ..... B66C 13/02 188/71.2
4,190,233 A * 2/1980 Godfrey ..... B66C 23/48 254/124
5,107,955 A * 4/1992 Kishi ..... B66F 11/046 182/14
7,607,643 B1 * 10/2009 Box ..... B66D 3/04 254/323
8,434,737 B2 * 5/2013 Zhou ..... B66C 23/48 254/2 B
8,511,644 B2 * 8/2013 Biesse ..... B66F 15/00 152/222
2004/0262490 A1 12/2004 King
2005/0045426 A1 3/2005 Rennetaud
2008/0105497 A1 * 5/2008 Ashley ..... B66F 11/042 187/269
2012/0043515 A1 * 2/2012 Finkbeiner ..... B66F 3/44 254/93 R

OTHER PUBLICATIONS

Paco Spiralift Inc. "Materials Handling With Electromechanincal Actuators Lifting Solutions" Down Loaded From Website pacospirialift.com on Oct. 28, 2014 p. 1.*

* cited by examiner

*Primary Examiner* — Lee D Wilson

(74) *Attorney, Agent, or Firm* — Charles L. Moore; Moore & Van Allen PLLC

(57) ABSTRACT

A collapsible and mobile lifting apparatus. The apparatus includes a mobile base, a lifting mechanism mounted to the mobile base, suspension members extending from the lifting mechanism for operatively engaging an object to be lifted, and a counterweight system that is automatically moveable relative to the mobile base. Helical band actuators provide the lifting force. A lower counterweight at the base is moveable to variable positions in response to the load of an object on the suspension members. An upper counterweight is mounted proximate to the upper end of the lifting mechanism to resist the load on the suspension members as well. A tension cable extending from the base proximate to the upper end of the lifting mechanism provides additional force to balance the load of the object.

20 Claims, 9 Drawing Sheets

LIFTING APPARATUS AND METHOD OF LIFTING

FIELD

The present disclosure relates to mechanized lifting of articles, and more particularly to lifting apparatus associated with a vehicle and associated methods.

BACKGROUND

Cranes, such as overhead cranes, are used to move and lift heavy objects. However, such conventional cranes, such as bridge cranes and gantry cranes, often require infrastructure and a large footprint in a factory. Further, some types of cranes are customized to lift and move certain objects. Customization may result in an expense to the owner and may also limit the purpose for which the crane is suited. Requisite infrastructure may include beams across the ceiling or between the walls of the factory, which may have high cost and also consequences related to the design of the ceiling, walls, and building overall. Crews for operating cranes are scheduled to perform a choreographed lifting and moving maneuver, and the crew's schedule may cause delays in manufacturing.

SUMMARY

In accordance with an embodiment disclosed herein, a lifting apparatus is provided that includes a mobile base adapted to be supported by and moveable relative to a floor surface, a lifting mechanism mounted to the mobile base, suspension members for operatively engaging an object to be lifted, the suspension members extending from the lifting mechanism, and a counterweight system that is automatically moveable relative to the mobile base.

In some embodiments in combination with the above embodiment, the counterweight system includes a lower counterweight moveably mounted to the mobile base that has a first position when there is no load on the suspension members and a variable second position to which the lower counterweight may move when there is a load on the suspension members. In some such embodiments, the second position of the lower counterweight is automatically adjusted in response to the load on the suspension members. In other such embodiments, the lower counterweight is actuated with a motor or a hydraulic cylinder for linear movement.

In some embodiments and in combination with any of the above embodiments, the counterweight system includes an upper counterweight proximate to the suspension members and a lower counterweight moveably mounted to the mobile base. In some such embodiments, a cable is connected at a first end at or proximate to an upper end of the lifting mechanism and is operably connected at a second end to the mobile base, and the cable has a certain tension, and the tension of the cable may be adjusted by a motor. In some such embodiments, the cable is operably connected to the mobile base through being held by the motor, and the motor is mounted to the lower counterweight.

In some embodiments and in combination with any of the above embodiments, a controller receives load information based on the load of an object being lifted and adjusts the counterweight system in response to the load information. In some such embodiments, the controller uses a feedback loop to continuously adjust the counterweight system in response to movement of the load. In some such embodiments, the counterweight system includes an upper counterweight proximate to the suspension members, a lower counterweight moveably mounted to the mobile base, a cable, and a motor. The lower counterweight is moveably mounted to the mobile base and has a first position when there is no load on the suspension members and a variable second position when there is a load on the suspension members. The cable is connected at a first end to the upper counterweight and is operably connected at a second end to the mobile base, with the cable having a certain tension that may be adjusted by the motor.

In some embodiments and in combination with any of the above embodiments, the lifting mechanism includes a helical band actuator. In some embodiments and in combination with any of the above embodiments, the lifting mechanism comprises at least one scissor mechanism that contributes to lateral support of the helical band actuator. In some such embodiments, the at least one scissor mechanism comprises two scissor mechanisms that are disposed in planes perpendicularly oriented relative to one another.

In some embodiments and in combination with any of the above embodiments, the suspension members comprise cantilevered beams each rotatably coupled to the lifting mechanism at a first end and extending to a free second end. In some such embodiments, the beams are remotely controlled to rotate in response to an input.

In accordance with another embodiment disclosed herein, a method of lifting an object is provided using a mobile base adapted to be supported by and moveable relative to a floor surface, a lifting mechanism mounted to the mobile base, and suspension members for operatively engaging the object to be lifted, the suspension members extending from the lifting mechanism. The method includes positioning the mobile base proximate to the object to be lifted, actuating the lifting mechanism and the suspension members to be above the object, operatively engaging the object with the suspension members, lifting the object to apply a load to the suspension members, and as the load is applied, measuring the load and automatically adjusting a counterweight system that is moveable relative to the base to offset the load.

In some embodiments and in combination with any of the above embodiments, the counterweight system includes a lower counterweight moveably mounted to the mobile base that has a first position when there is no load on the suspension members and a variable second position when there is a load on the suspension members. Adjusting the counterweight system includes moving the lower counterweight relative to the base. In some such embodiments, the counterweight system includes an upper counterweight proximate to the suspension members. A cable is connected at a first end at or proximate to an upper end of the lifting mechanism and is operably connected at a second end to the mobile base and is operably connected at a second end to the mobile base. The cable has an initial tension, and adjusting the counterweight system includes changing the tension of the cable with a motor. In some such embodiments, automatically adjusting the control system comprises receiving load information with a control system based on the load of an object being lifted and using a feedback loop to adjust the counterweight system in response to the load information.

Other aspects and features of the present disclosure, as defined solely by the claims, will become apparent to those ordinarily skilled in the art upon review of the following non-limited detailed description of the disclosure in conjunction with the accompanying figures.

BRIEF DESCRIPTION OF THE DRAWINGS

The following detailed description of embodiments refers to the accompanying drawings, which illustrate specific embodiments of the disclosure. Other embodiments having different structures and operations do not depart from the scope of the present disclosure.

DESCRIPTION

Figure 1:
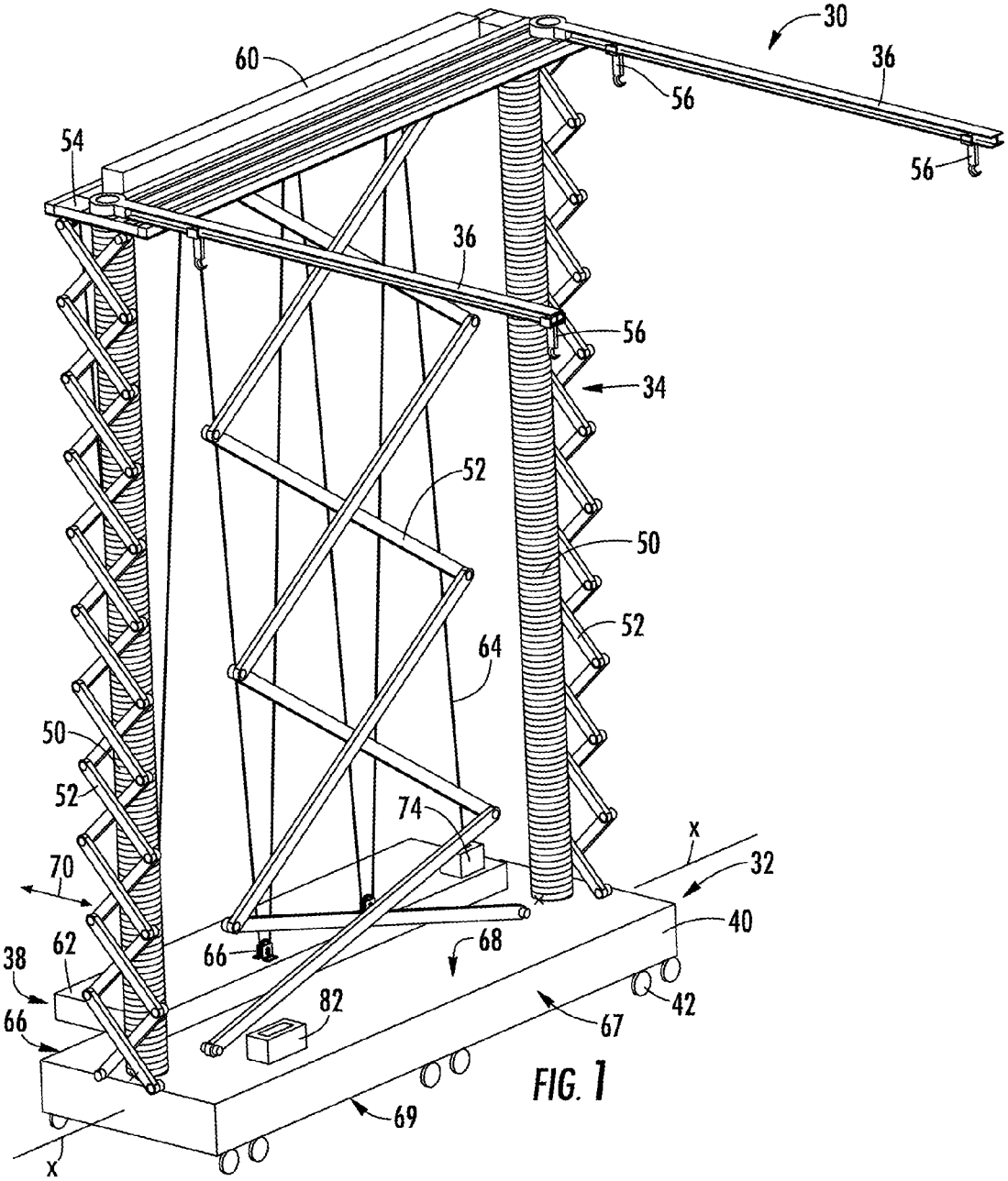
FIG. 1 is a perspective view of a lifting apparatus in accordance with an embodiment of the present disclosure, with the lifting apparatus in an extended position.
Figure 2:
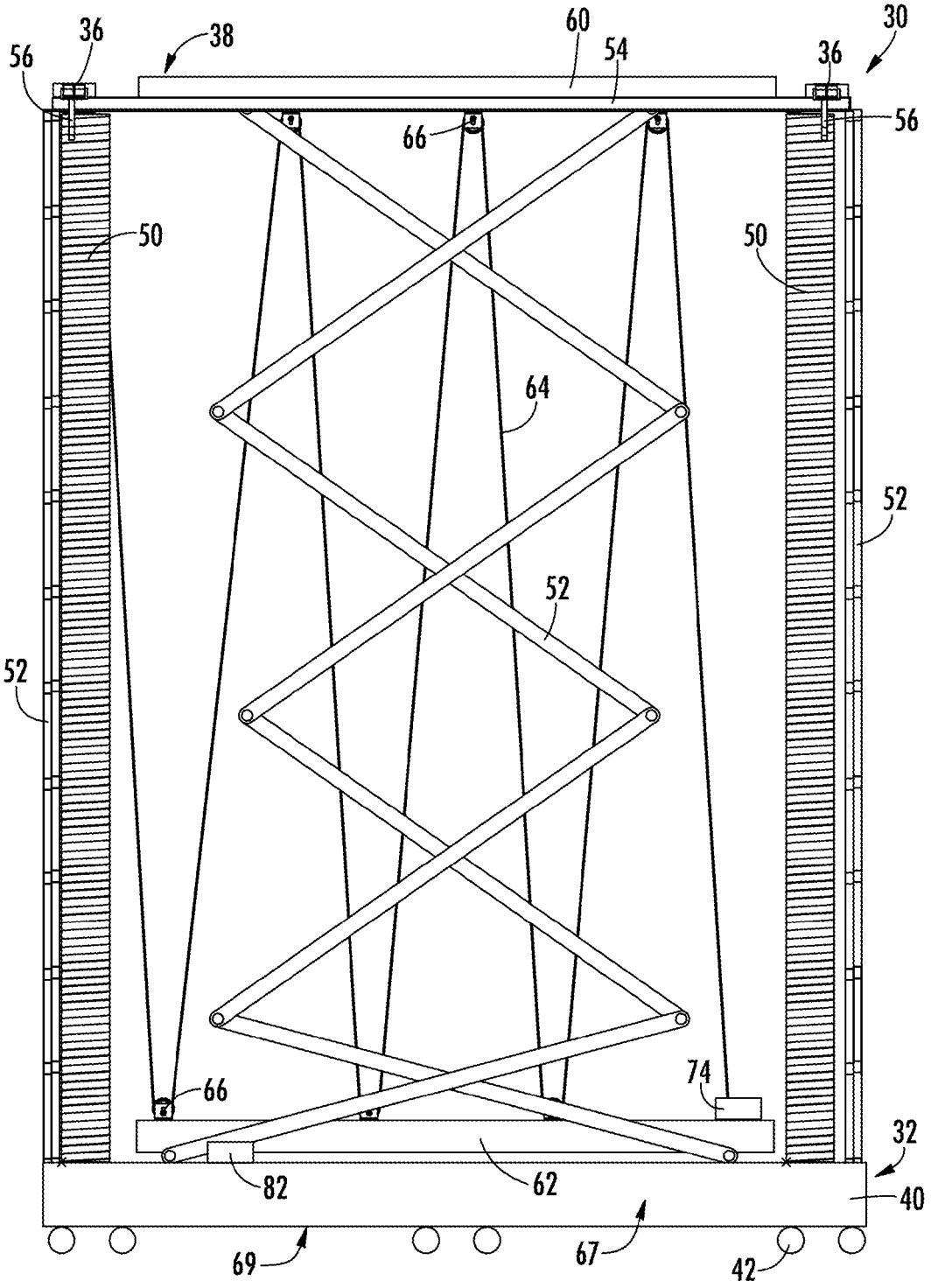
FIG. 2 is a front view of the extended lifting apparatus of FIG. 1.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

Certain terminology is used herein for convenience only and is not to be taken as a limitation on the embodiments described. For example, words such as "proximal", "distal", "top", "bottom", "upper," "lower," "left," "right," "horizontal," "vertical," "upward," and "downward" merely describe the configuration shown in the figures or relative positions. The referenced components may be oriented in any direction and the terminology, therefore, should be understood as encompassing such variations unless specified otherwise.

The apparatus described herein avoids specialized crane infrastructure and may reduce the collapsed height of the apparatus. Further, the apparatus described herein is portable and allows lifting of objects without requiring, for example, the mounting of equipment from the ceiling of a building.

Figure 3:
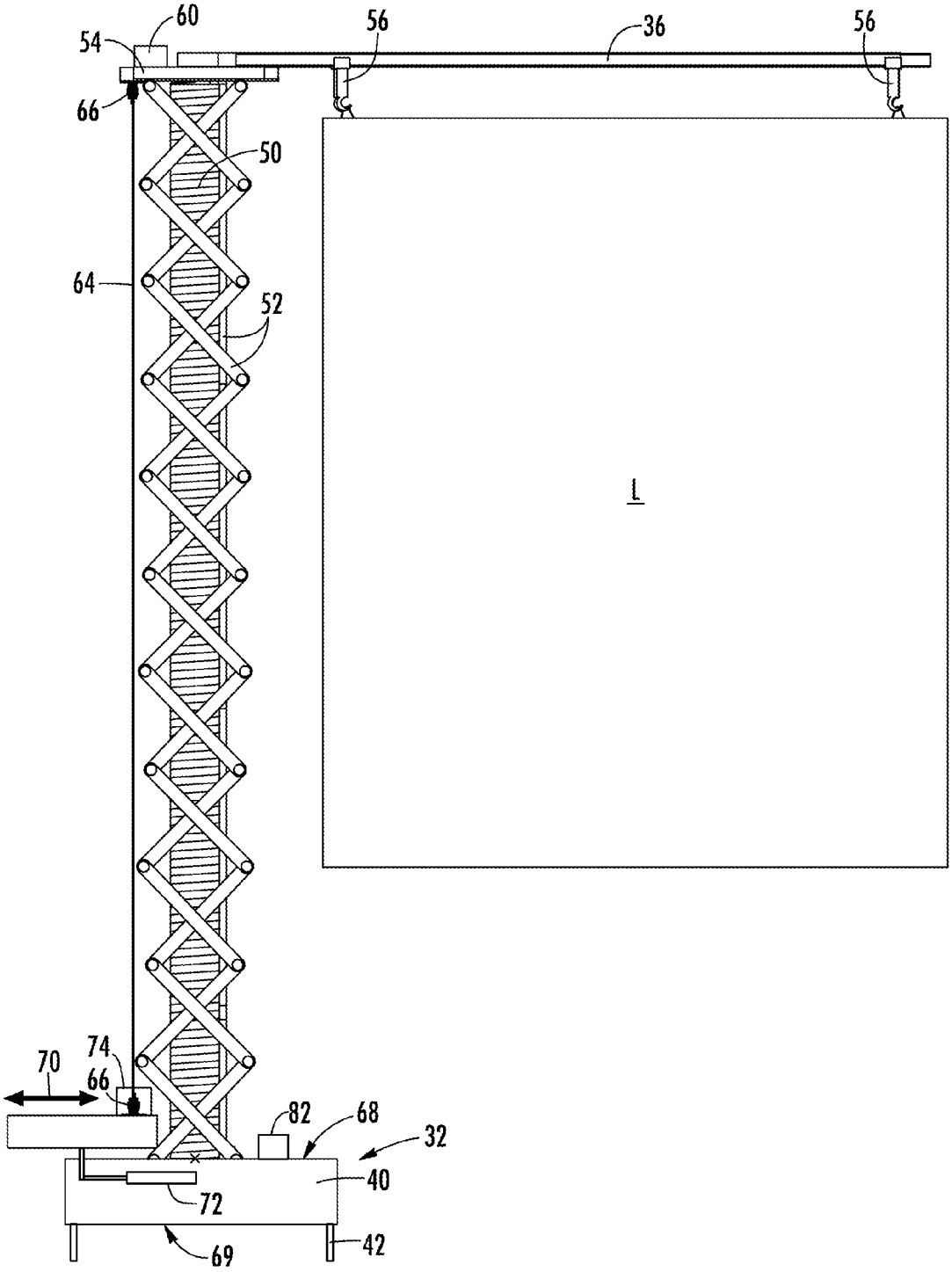
FIG. 3 is a side view of the extended lifting apparatus of FIG. 1.
Figure 4:
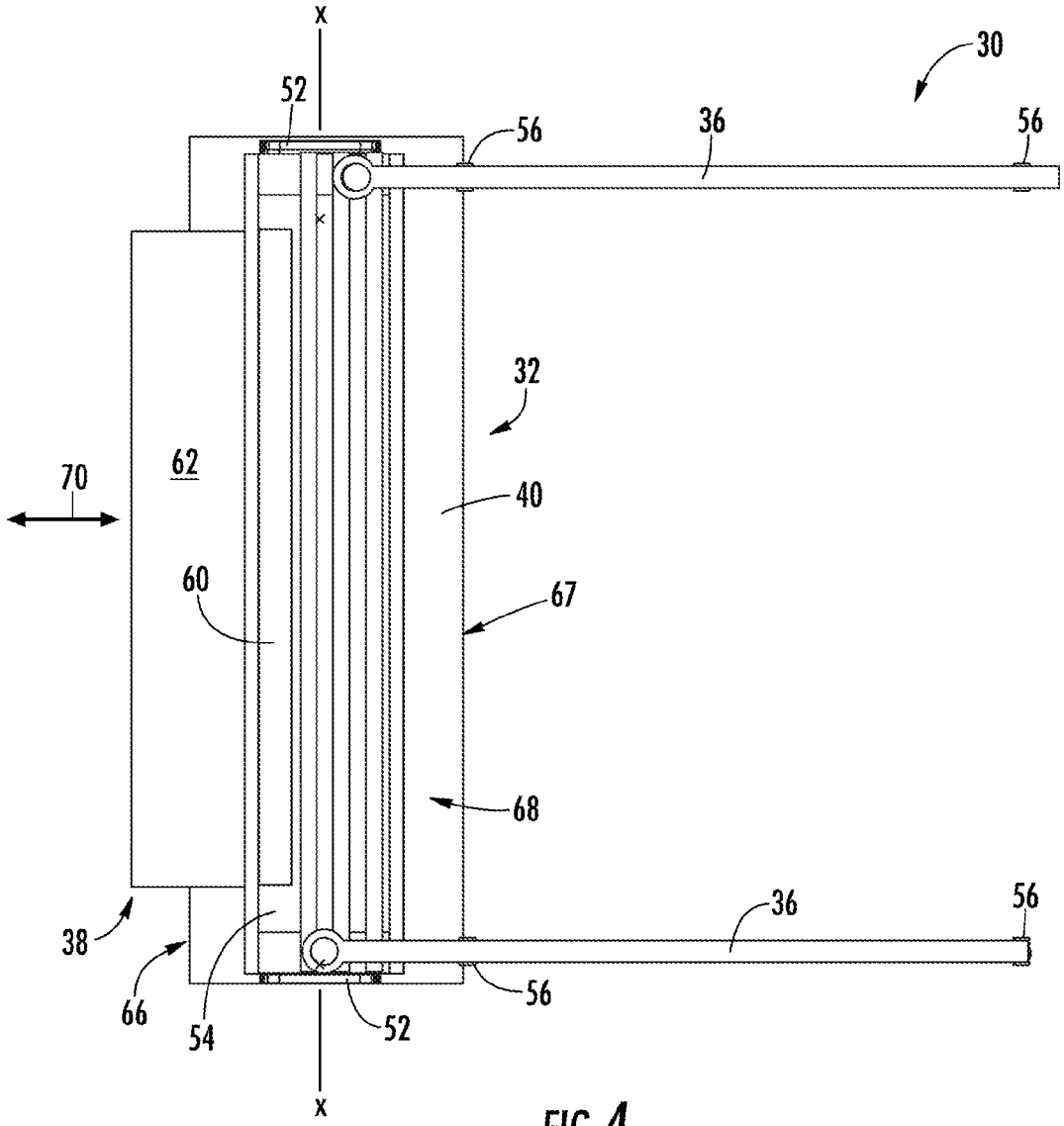
FIG. 4 is a top view of the extended lifting apparatus of FIG. 1.
Figure 5:
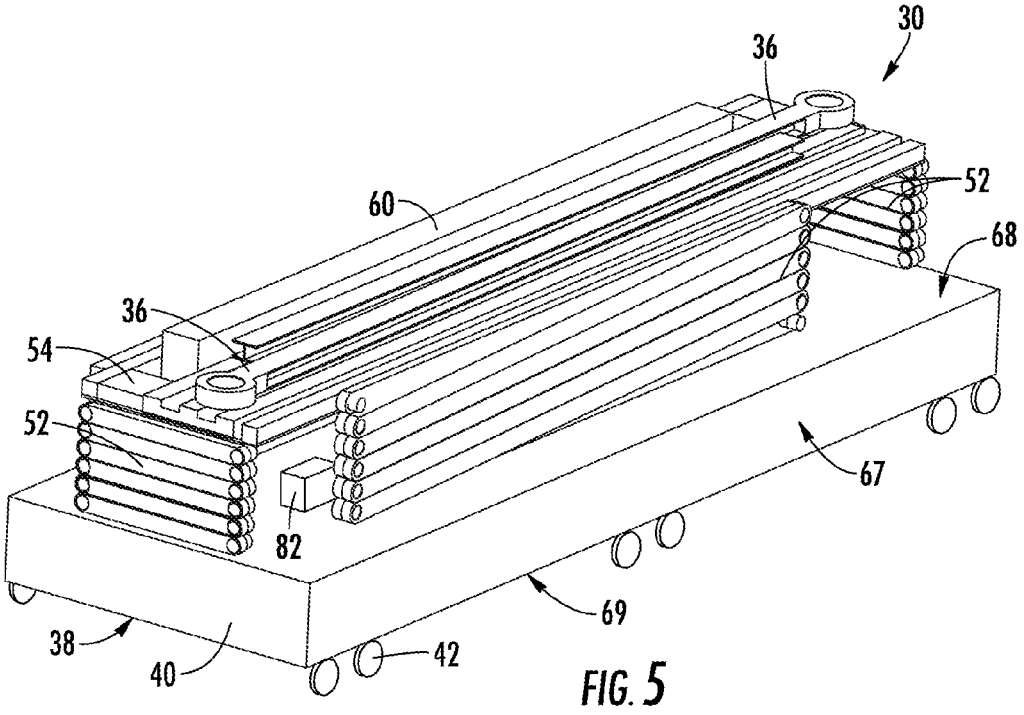
FIG. 5 is a perspective view of the lifting apparatus of FIG. 1, with the lifting apparatus in a collapsed position.
Figure 6:
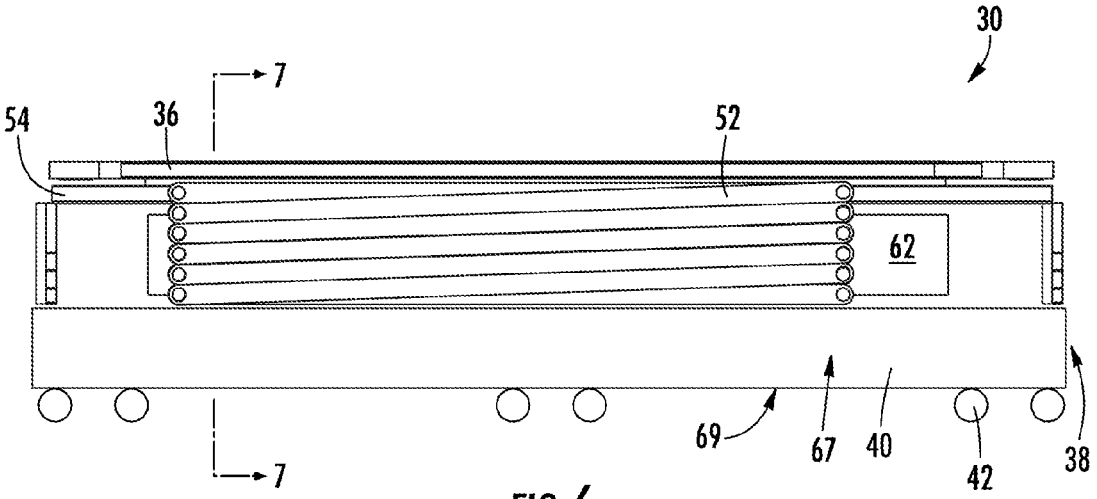
FIG. 6 is a front view of the collapsed lifting apparatus of FIG. 5.

FIGS. 1-8 show a lifting apparatus or lifter 30 in two positions; in FIGS. 1-4 the lifter 30 is in an extended position for use in lifting an object, and in FIGS. 5-8 the lifter 30 is in a collapsed or compacted position for reduced volumetric footprint, transport, or storage. The lifter 30 may include a mobile base 32, a lifting mechanism 34 also mounted to the mobile base 32, suspension members 36 mounted to the lifting mechanism 34, and a counterweight system 38 mounted to the mobile base 32. An exemplary object being a panel indicated by load L is shown in FIG. 3.

The mobile base 32 may be automated, remotely controlled, and/or manually controlled, and may move in any direction based on input commands, a predefined program, or both. The mobile base 32 may be, in one embodiment, a self-guided vehicle such as an automated guided vehicle (AGV) that allows for automated omni-directional movement for accurate placement of loads. The mobile base 32 as a self-guided vehicle may also allow for autonomous storage of the apparatus. Such a self-guided vehicle may be selected and modified as appropriate by one of ordinary skill in the art. The mobile base 32 may include a body 40, for example, a platform, a structure formed from elongated members, or a combination thereof, with wheels 42 or other rollers.

The lifting mechanism 34 may be mounted to the mobile base 32 and include one or more lifting components 50 and scissor mechanisms 52 that may be mounted to a lifting platform 54, which may be a steel plate. In this embodiment, the lifting components 50 are shown as two helical band actuators, such as the Spiralift Model No. ND18-30 as manufactured by Paco Spiralift Inc. of Quebec, Canada. Helical band actuators take up considerably less space when collapsed than a hydraulic actuator of comparable capacity and extension length. Lateral stability may be provided by scissor mechanisms 52. Lateral stability may be provided in more than one direction by placing the scissor mechanisms 52 at an angle to each other; in this embodiment a first scissor mechanism 52 is in a plane parallel to the front of the mobile base 32 while the other scissor mechanisms 52 are in planes perpendicular to the first one. The scissor mechanisms 52 may make some contribution to lifting, but the primary purpose is to provide lateral stability as a load is raised while the lifting components 50 support the load. The ends of the scissor mechanisms 52 at the mobile base 32 may be actuated and held in place as known by one of ordinary skill in the art, for example, in tracks and with motors (not shown). The scissor mechanisms 52 collapse as the helical band actuators 50 retract.

Two suspension members, which may be, for example, steel support beams or cantilevered beams 36, are shown as being pivotally mounted to the lifting platform 54, and are therefore generally at or near the top of the lifting mechanism 34. In the extended position of FIG. 1, the cantilevered beams 36 are rotated to be perpendicular to the lifting platform 54 in an extended position, but could be at any suitable angle relative to the lifting platform 54. Hooks or other engagement members 56 may be provided along the cantilevered beams 36 to engage the object to be lifted. The cantilevered beams 36 and lifting platform 54 are raised by the helical band actuators 50, and for descent the cantilevered beams 36 may be rotated to a retracted, storage position in which they may fit within the footprint of the mobile base 32. The movement of the cantilevered beams 36 relative to the lifting mechanism 34 may be controlled automatically, remotely, and/or via user inputs.

The counterweight system 38 may include an upper counterweight 60 that may be mounted to the lifting platform 54, a lower counterweight 62 that may be mounted to the mobile base 32, a tension support cable 64 extending between the lifting platform 54 and the lower counterweight 62 in a path set by pulleys 65, or any combination thereof. The upper counterweight 60 may extend along a long side 66 of the lifting platform 54, parallel to the longitudinal axis X-X (FIGS. 1 and 4) and on the opposite side of the lifting platform 54 from the cantilevered beams 36, may be fixed relative to the lifting platform 54, and counteracts the moment created from the load on the cantilevered beams 36.

Figure 7:
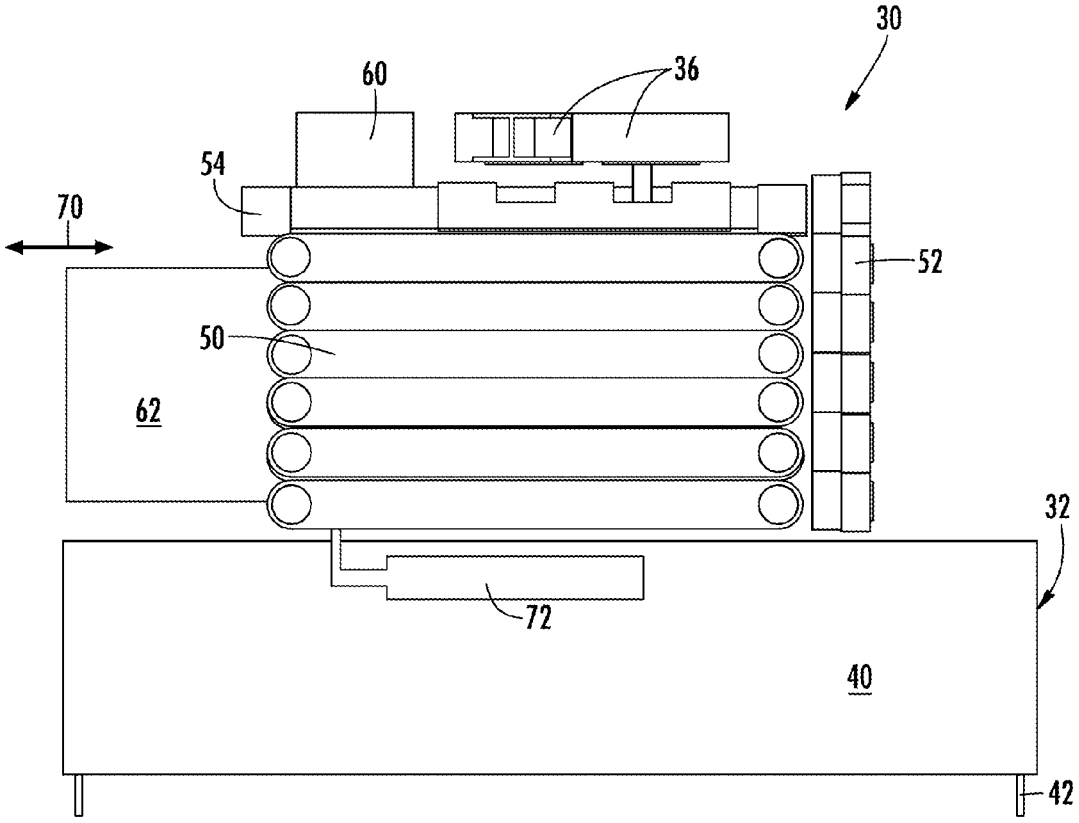
FIG. 7 is a side view of the collapsed lifting apparatus of FIG. 5.
Figure 8:
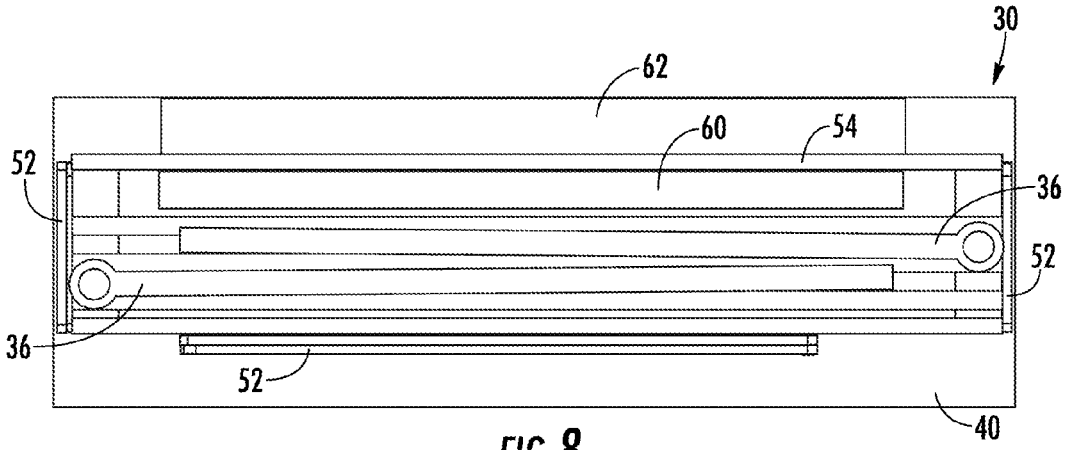
FIG. 8 is a top view of the collapsed lifting apparatus of FIG. 5.

The lower counterweight 62 may be linearly or otherwise moveable in the direction 70 toward and away from the longitudinal axis X-X of the mobile base 32, which is centrally positioned between the long sides 66, 67 and the top and bottom surfaces 68, 69 of the mobile base 32. The lower counterweight 62 may have a length that permits the lower counterweight 62 to fit between the helical band actuators 50 when in the collapsed position, as best seen in the extended position of FIG. 4. In the extended position, the lower counterweight 62 extends outward of the side 66 of the mobile base 32, while when the lifter 30 is in the collapsed position, the lower counterweight 62 may retract to place all or substantially all of the lower counterweight 62 over the mobile base 32, as shown in FIG. 7. The lower counterweight 62 may be moved by actuators 72, such as one or more motors or hydraulic actuators, and may be moved linearly or otherwise with directional control by travel in tracks or other methods selected by one of ordinary skill in the art. In some embodiments, the upper counterweight 60 may be moveable similarly to the lower counterweight and in the same manner, such as in a direction parallel to the direction 70.

The counterweight system 38 is shown as including actual weights, but can be any system that provides a variable counteracting force to the load on the cantilevered beams 36. In the exemplary embodiment, the counterweight system 38 includes a lower counterweight 62 and an upper counterweight 60, where one or both of the counterweights 60, 62 can move with respect to the mobile 32 base and/or the lifting mechanism 34. When the counterweights 60, 62 are actual weights, they can each move independently toward or away from the load supported on the beams 36. By adjusting the position of one or more of the counterweights, the counterweight force can be varied as the load on the cantilevered beams 36 is lifted by the lifting mechanism 34.

The tension support cable 64 may serpentine through a plurality of pulleys 65, alternating between the lifting platform 54 and the lower counterweight 62 to which the pulleys are mounted. The pulleys 65 distributed along the lifting platform 54 and/or the upper counterweight 60 distribute the force applied by the cable generally longitudinally along the lifting platform 54. At one end of the cable 64, in this embodiment at one end of the lower counterweight 62, a motor 74 (shown in FIG. 3) may dispense or retract the cable 64, depending on whether the lifting platform 54 is going up or down. The motor 74 may also apply tension to the cable 64. The tension on the cable 64 provides a compressive load to counteract the moment created from the load on the cantilevered beam 36.

Figure 9:
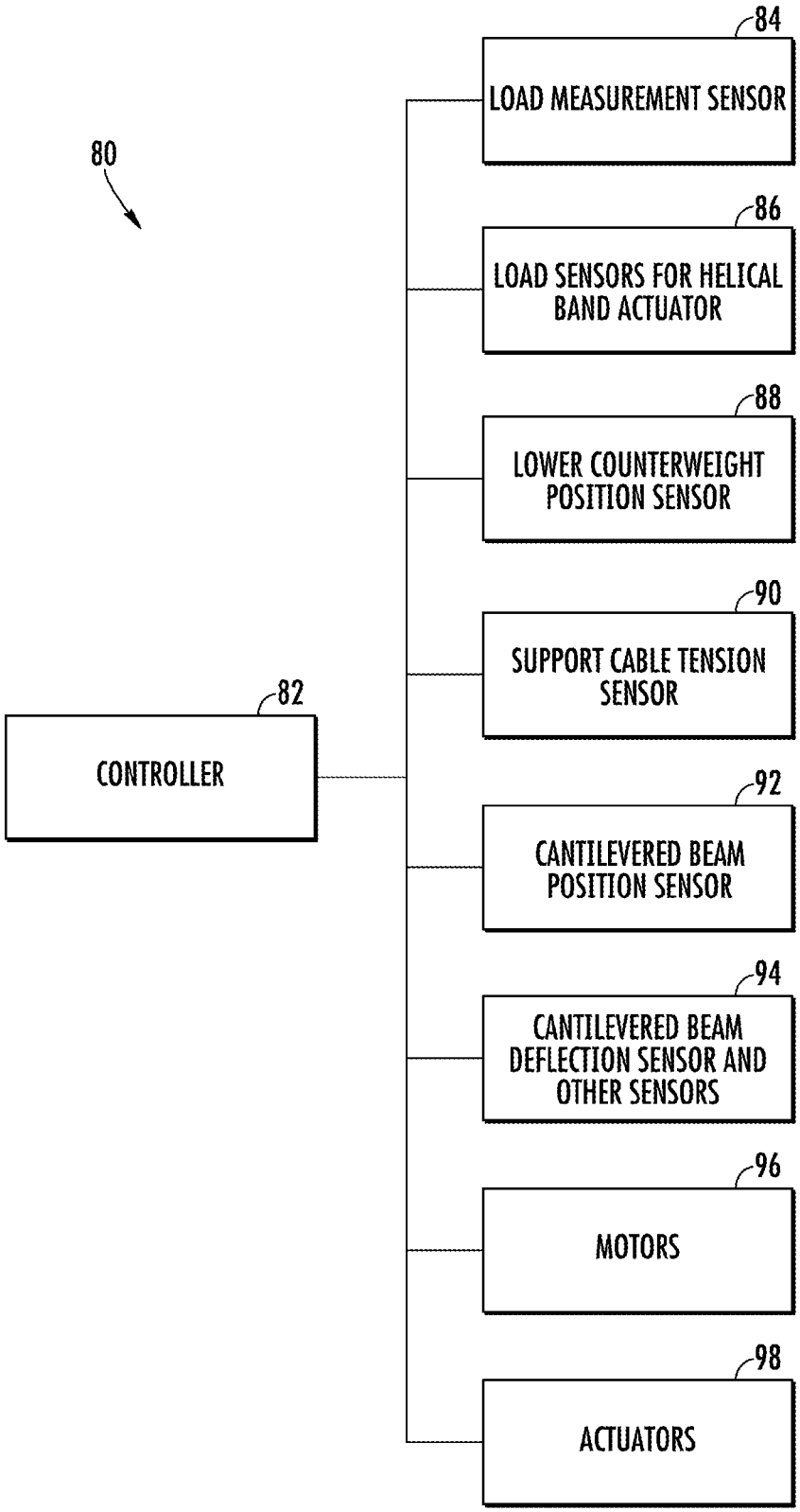
FIG. 9 is a block diagram of an embodiment of a control system for the lifting apparatus of FIGS. 1 and 5.

As shown in FIG. 9, the lifter 30 includes a control system 80 operatively coupled to the mobile base 32, lifting mechanism 34, cantilevered beams 36, and the counterweight system 38. The counterweight system 38 adjusts automatically based on the cantilevered beam 36 loading conditions, which may be performed under the direction of a controller 82. A load measurement sensor 84 provides load measurements to the control system 80 to adjust the counterweight system 38, and various optional sensors may be provided. In one embodiment, the adjustment is made by the control system 80 through the application of the one or more programmable controllers 82 that are in communication with various sensors, such as electrical or wireless communication, including weighing or load sensors 86 associated with the helical band actuators 50, sensors 88 of the position of the lower counterweight 62, a sensor 90 of the tension in the tension support cable 64, position sensors 92 for the cantilevered beams 36, and in some embodiments, deflection sensors associated with the cantilevered beams 36 and potentially other sensors 94. Based on known, preset lengths, weights, and positions of features, the moment at the lifting platform 54 at any given height and at the mobile base 32 may be a calculation programmed into the controller 80, and the controller 80 may signal motors 96 and actuators 98 to adjust the position of the lower counterweight 62, the tension on the cable 64, and the positions of the cantilevered beams 36. The various sensors 84, 86, 88, 90, 92, 94, motors 96, and/or actuators 98 may be optional depending on the desired control configuration.

The control system 80 also controls movement of the mobile base 32 from one location to another location, with or without the load supported on the cantilevered beams 36. For example, before the load is positioned on the cantilevered beams 36, the cantilevered beams 36 are in the retracted position, the lifting mechanism 34 is lowered, and the mobile base 32 is controlled to move the lifting mechanism 34 to the load. If needed, the lifting mechanism 34 is positioned at the appropriate height for the load, and the cantilevered beams 36 are then extended to receive the load thereon. The counterweight system 38 is adjusted by the controller 82 to compensate for the force exerted by the load. If the load is to be moved to an assembly location, the mobile base 32 is controlled to move the load. Once at the assembly location, the lifting mechanism 34 extends upward to lift the load, and the counterweight system 38 automatically adjusts to compensate for changes in the moment generated by the force of the load on the cantilevered beams 36 as the load is raised.

Figure 10A:
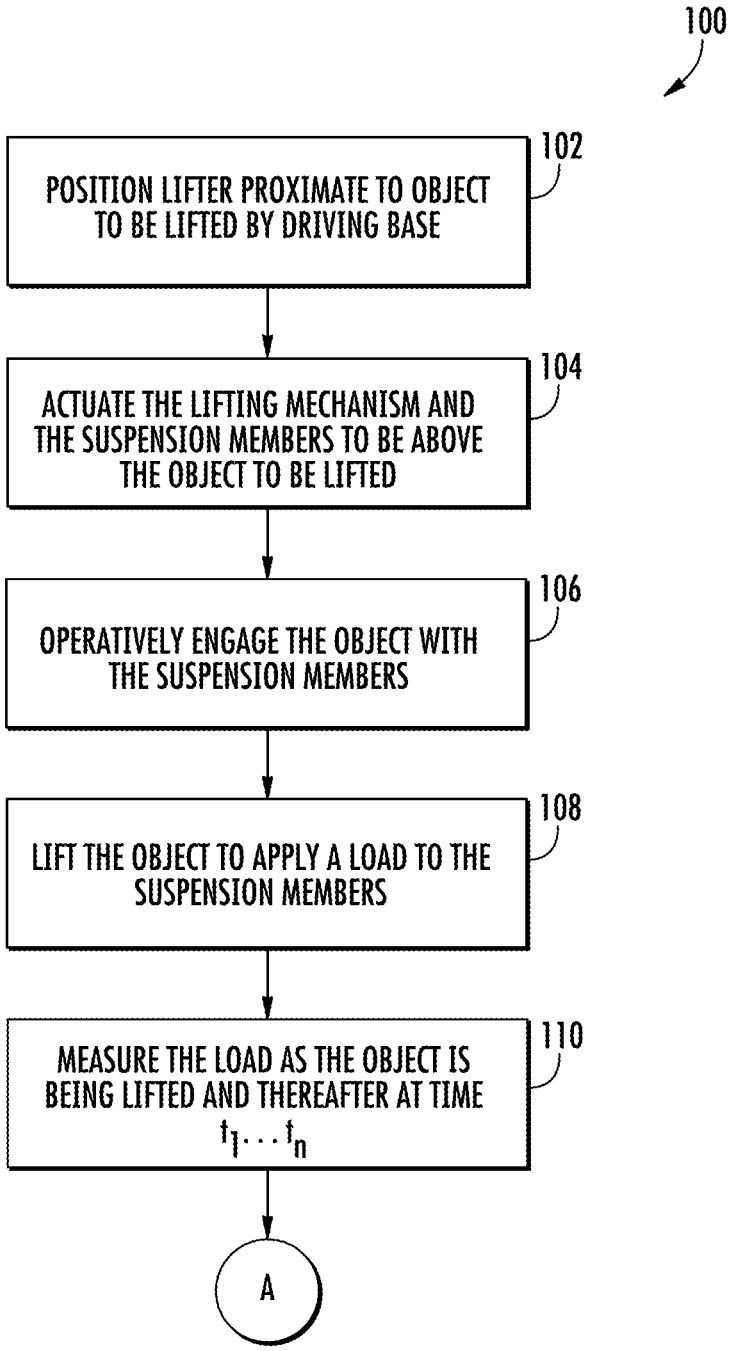
FIGS. 10A and 10B are a flow chart showing a method of operation of the lifting apparatus of FIG. 1.
Figure 10B:
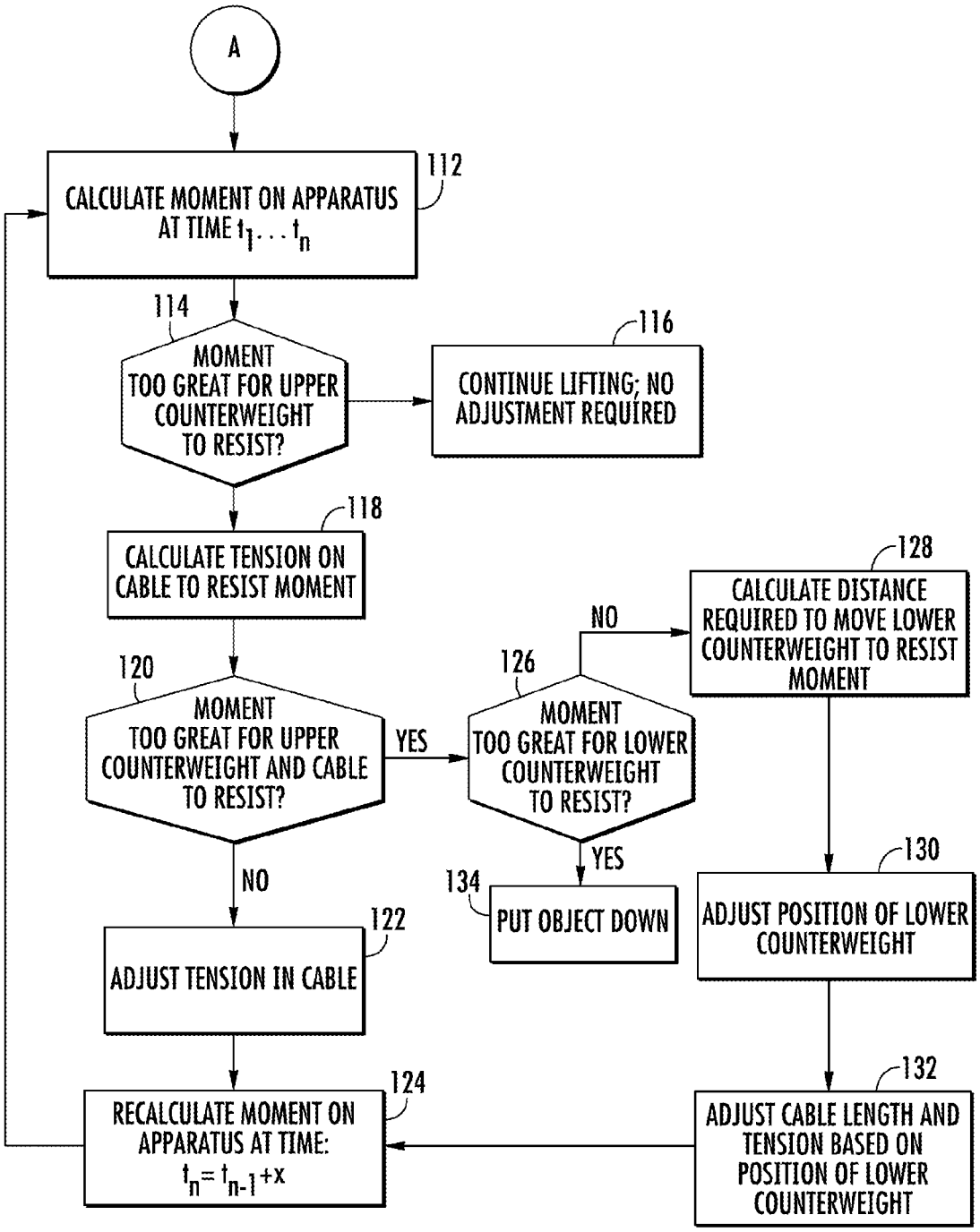

FIGS. 10A and 10B show one embodiment of a method of operation 100 of the lifter 30, as may be controlled by the control system 80 having one or more controllers 82. The lifter 30 is positioned proximate to the object to be lifted 102, which in some cases may be aircraft panels. The lifting mechanism is actuated as are the suspension members, by rotation, to be above the object to be lifted 104. The object is operatively engaged with the suspension members 106, and the object is lifted to apply a load to the suspension members 108. The load is then measured as the object is being lifted, and thereafter, at times $t_1$ through $t_n$ 110. The moment on the apparatus at time $t_1$ is calculated 112. The moment on the apparatus may be compared to several thresholds for each of the elements of the counterweight system 38. If a moment to be counteracted by an element, i.e. the upper counterweight 60, the cable 64, or the lower counterweight 62, exceeds the threshold or is "too great" for that element to counteract, the next element may need to be applied, or the article put down. Specifically, if the moment is not too great for the upper counterweight to resist 114, no adjustment of the counterweight system (by changing the tension of the cable or the position of the lower counterweight) is required and lifting may continue 116. If the moment is too great for the upper counterweight to resist 114, the tension initial tension on the cable may be adjusted, with the tension on the cable required to resist that moment being calculated 118. If the moment on the apparatus is not too great for the upper counterweight and the cable to resist 120, the tension in the cable is adjusted 122, and the moment on the apparatus is recalculated 124, returning to step 112.

If the moment on the apparatus is too great for the upper counterweight and the cable to resist 120, it is considered whether the moment is also too great for the lower counterweight to resist 126. If the moment is not too great for the lower counterweight to resist 126, the distance required to move the lower counterweight to resist movement is calculated 128, and the position of the lower counterweight is adjusted 130. Then the cable length and tension is adjusted based on the position of the lower counterweight 132, and the moment on the apparatus is recalculated at time $t_n=t_{n-1}+x$, where x is the preset elapsed time between calculations 124, such as 0.1 seconds, returning to step 112, with what may be considered continuous feedback and adjustment. If the moment on the apparatus is too great for the lower counterweight to resist 122, the lifter is to stop lifting and return the object to its original position 134.

The apparatus may be substantially compactible vertically; in one embodiment the extended height may be approximately 35.5 feet (ft) (10.8 meters (m)) with a collapsed height of approximately 7 ft (2.1 m). Accordingly, in various embodiments the ratio of extended height to collapsed height may range approximately from 3:1 to 7:1 or greater, and in the embodiment discussed above may be approximately 5:1, where the collapsed height is less than 10 ft (3.0 m). In one embodiment the footprint may be approximately 8.5 ft (2.6 m) wide by approximately 25.5 ft (7.8 m) long.

The terminology used herein is for the purpose of describing particular embodiments only and is not intended to be limiting of the disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

What is claimed is:

1. A lifting apparatus, comprising:

a mobile base adapted to be supported by and moveable relative to a floor surface;

a lifting mechanism mounted to the mobile base;

suspension members for operatively engaging an object to be lifted, the suspension members extending from the lifting mechanism;

a counterweight system that is automatically moveable relative to the mobile base; and a controller that receives load information based on a load of the object being lifted and adjusts the counterweight system in response to the load information.

2. The lifting apparatus of claim 1, wherein the counterweight system includes a lower counterweight moveably mounted to the mobile base, the lower counterweight having a first position when there is no load on the suspension members and a variable second position to which the lower counterweight may move when there is a load on the suspension members.

3. The lifting apparatus of claim 2, wherein the second position of the lower counterweight is automatically adjusted in response to the load on the suspension members.

4. The lifting apparatus of claim 2, wherein the lower counterweight is actuated with an actuator for linear movement.

5. The lifting apparatus of claim 4, wherein the actuator comprises one of a motor and a hydraulic cylinder.

6. The lifting apparatus of claim 1, wherein the counterweight system includes an upper counterweight proximate to the suspension members and a lower counterweight moveably mounted to the mobile base.

7. The lifting apparatus of claim 6, wherein a cable is connected at a first end at or proximate to an upper end of the lifting mechanism and is operably connected at a second end to the mobile base, and the cable has an initial tension, and the tension of the cable may be adjusted by a motor.

8. The lifting apparatus of claim 7, wherein the cable is operably connected to the mobile base through being held by the motor, and the motor is mounted to the lower counterweight.

9. The lifting apparatus of claim 1, wherein the controller uses a feedback loop to continuously adjust the counterweight system in response to movement of the load.

10. The lifting apparatus of claim 9, wherein the counterweight system comprises an upper counterweight proximate to the suspension members, a lower counterweight moveably mounted to the mobile base, a cable, and a motor, wherein the lower counterweight is moveably mounted to the mobile base and has a first position when there is no load on the suspension members and a variable second position when there is a load on the suspension members, and wherein the cable is connected at a first end at or proximate to an upper end of the lifting mechanism and is operably connected at a second end to the mobile base and is operably connected at a second end to the mobile base, the cable having a certain tension that may be adjusted by the motor.

11. The lifting apparatus of claim 1, wherein the lifting mechanism comprises a helical band actuator.

12. The lifting apparatus of claim 1, wherein the lifting mechanism comprises at least one scissor mechanism that contributes to lateral support of the helical band actuator.

13. The lifting apparatus of claim 12, wherein the at least one scissor mechanism comprises two scissor mechanisms that are disposed in planes perpendicularly oriented relative to one another.

14. The lifting apparatus of claim 1, wherein the suspension members comprise cantilevered beams each rotatably coupled to the lifting mechanism at a first end and extending to a free second end.

15. The lifting apparatus of claim 14, wherein the beams are remotely controlled to rotate in response to an input.

16. A method of lifting an object using a mobile base adapted to be supported by and moveable relative to a floor surface, a lifting mechanism mounted to the mobile base, and suspension members for operatively engaging the object to be lifted, the suspension members extending from the lifting mechanism, the method comprising:

positioning the mobile base proximate to the object to be lifted;

actuating the lifting mechanism and the suspension members to be above the object;

operatively engaging the object with the suspension members;

lifting the object to apply a load to the suspension members; and as the load is applied, measuring the load and automatically adjusting a counterweight system that is moveable relative to the base to offset the load.

17. The method of lifting an object of claim 16, wherein the counterweight system includes a lower counterweight moveably mounted to the mobile base that has a first position when there is no load on the suspension members and a variable second position when there is a load on the suspension members, and adjusting the counterweight system includes moving the lower counterweight relative to the base.

18. The method of lifting an object of claim 17, wherein the counterweight system includes an upper counterweight proximate to the suspension members, a cable is connected at a first end to the upper counterweight and is operably connected at a second end to the mobile base, the cable has an initial tension, and adjusting the counterweight system includes changing the tension of the cable with a motor.

19. The method of lifting an object of claim 18, wherein automatically adjusting the control system comprises receiving load information with a control system based on the load of an object being lifted and using a feedback loop to adjust the counterweight system in response to the load information.

20. A lifting apparatus, comprising:

a mobile base adapted to be supported by and moveable relative to a floor surface;

a lifting mechanism mounted to the mobile base;

suspension members for operatively engaging an object to be lifted, the suspension members extending from the lifting mechanism; and a counterweight system that is movable relative to the mobile base to offset a load of the object, the counterweight system being adjusted in response to measuring the load of the object as the object is being lifted.

* * * * *